US005309613A

United States Patent [19]

Strahm

[11] Patent Number: 5,309,613

[45] Date of Patent: May 10, 1994

[54] PROCESS AND APPARATUS FOR IMPROVING THE HANDLE AND SURFACE OF TEXTILE FABRICS AND KNITTED MATERIALS

[75] Inventor: Christian Strahm, Bronschhofen, Switzerland

[73] Assignee: Solipat AG, Zug, Switzerland

[21] Appl. No.: 947,584

[22] Filed: Sep. 21, 1992

[30] Foreign Application Priority Data

Sep. 21, 1991 [CH] Switzerland ..... 2804/91

[51] Int. Cl.[5] ..... D06C 19/00

[52] U.S. Cl. ..... 26/27; 26/21

[58] Field of Search ..... 26/27, 1, 18.5, 18.6, 26/19, 20, 21, 22, 25; 34/155, 191; 28/165, 116

[56] References Cited

U.S. PATENT DOCUMENTS

| | | | |
|---|---|---|---|
| 3,718,012 | 2/1973 | Vinas | 68/184 |
| 4,055,003 | 10/1977 | Sack | 26/1 |
| 4,392,309 | 7/1983 | Schrader | 26/18.5 |
| 4,679,333 | 7/1987 | Vinas | 26/18.5 |
| 4,773,133 | 9/1988 | Voisin et al. | 26/18.5 |

*Primary Examiner*—Clifford D. Crowder
*Assistant Examiner*—Amy B. Vanatta
*Attorney, Agent, or Firm*—Fisher & Associates

[57] ABSTRACT

The material web (3) to be treated is supplied continuously to a first material web store (1) and stored there in sections, is removed therefrom by being pneumatically conveyed and is hurled compressively against a first impact surface (4). Thereafter, the material (3) compressed in this way is supplied to a second material web store (2) and stored there in sections. Then, the same procedure is carried out in the opposite direction of conveying from the second material web store (3) against a second impact surface (4') and thereafter to the first material web store (1), but with a smaller length advance of the material web, this alternating movement is repeated alternately, and the difference in advance between these length sections of material web moved to and fro is guided away continuously from the second material web store (2).

21 Claims, 2 Drawing Sheets

PROCESS AND APPARATUS FOR IMPROVING THE HANDLE AND SURFACE OF TEXTILE FABRICS AND KNITTED MATERIALS

The invention relates to a process for continuously improving the handle and surface of textile fabrics and knitted materials, and to an apparatus for carrying out this process.

In finishing textiles, a greater degree of softness, that is to say an improvement in handle and surface, is frequently desirable.

The object of the present invention is in particular to provide a process by means of which an improvement in handle and surface, that is to say a greater degree of softness of textile fabrics and knitted materials, can be achieved.

This object is achieved in a process of the type mentioned at the outset in accordance with the invention, in that the material web to be treated is supplied continuously to a first material web store and stored there in sections, is removed therefrom by being pneumatically conveyed and is hurled compressively against a first impact surface, thereafter the material compressed in this way is supplied to a second material web store and stored there in sections, then the same procedure is carried out in the opposite direction of conveying from the second material web store against a second impact surface and thereafter to the first material web store, but with a smaller length advance of the material web, these alternating movements are repeated alternately, and during this the difference in advance between these length sections of material web moved to and fro is guided away continuously from the second material web store.

Here, it can be advantageous if the material guided away from the second material web store is then subjected at least one more time to a similar treatment process.

Here, it is advantageous if the material web to be treated is hurled against the respective impact surface at a speed in the range from 400 to 1000 m/min, preferably at a speed in the range from 600 to 800 m/min.

To produce a loose storage of the material to be treated and the possibility of problem-free removal at the same time thereof from the material web stores, it is advantageous if the material to be treated is temporarily stored in sections in at least approximately U-shaped material web stores, the material to be treated and temporarily to be stored being introduced continuously into one leg of the first U-shaped material web store, being removed continuously alternately and in sections from the other second leg, being returned again thereto in the opposite direction of transport, being removed again therefrom and so on, the treated material being introduced continuously alternately and in sections into one leg of the second material web store, being removed again therefrom in the opposite direction of transport, being returned thereto again and so on, and the material whereof treatment is complete being removed continuously from the other second leg of the second U-shaped material web store.

In order to prevent the two material web stores from respectively being filled to too great an extent on the one hand or emptied too little on the other hand, it is advantageous if the to-and-fro movement of the material web sections to be treated between the two impact surfaces is controlled by means of monitoring means, preferably optical sensor means, which sense the level of filling of the two material web stores thereof.

Advantageous further developments of the process according to the invention are the subject of claims 6 to 9.

The invention further has as its subject an apparatus for carrying out the process according to the invention, this apparatus being characterized in that it has two material web stores each for loosely receiving one material web section, a material web guidance and acceleration channel which is arranged between these two material web stores, connects them to one another and is delimited in its longitudinal direction at its two end sides by a respective material web impact surface, pneumatic conveying means which are connected to the material web guidance and acceleration channel and which can be brought into effect in a manner such that they can be changed over in the two mutually opposed longitudinal directions of the material web guidance and acceleration channel, for alternately conveying a material web section in the mutually opposed longitudinal directions of the guidance and acceleration channel against the respective end-side material web impact surface and from this into the respectively associated material web store, a supply arrangement for continuously supplying the material web to be treated to the first material web store, and a removal arrangement for continuously guiding away the treated material web from the second material web store.

Here, it is advantageous if the two material web stores are constructed to be at least approximately U-shaped and are preferably provided in their interior with optical sensor means for sensing their level of filling with part sections of the material web to be treated, one leg of the U-shaped first material web store being constructed for the continuous temporary receiving in sections of the material to be treated and the other leg for the continuously alternating removal in sections, return directed in the opposite direction of transport, renewed removal and so on, and one leg of the U-shaped second material web store being constructed for the continuously alternating receiving in sections, removal directed in the opposite direction, renewed receiving and so on, and the other leg of the second material web store for the continuous removal of the treated material.

To achieve high-speed acceleration which does not however have a negative effect on the material to be treated, it is advantageous if the pneumatic conveying means associated with the acceleration channel are divided into two pneumatic conveying means groups acting in two mutually opposed directions of the acceleration channel, and these two groups are connected to a compressed-air source, alternating separately from one another, by way of a changeover element which preferably operates in accordance with the Coanda effect principle, these two groups having on either side of the acceleration channel blower nozzles which are arranged alternately laterally offset with respect to one another and are directed obliquely with respect to the plane of transport of the material web, and these two groups being arranged in the end region of the acceleration channel, as seen in their respective direction of conveying.

To achieve a greater degree of flexibility in operation of the apparatus according to the invention, it is advantageous if the supply and removal arrangements are constructed to be regulable independently of one another as regards their transporting speed.

To prevent an air cushion which reduces the compressive effect, it is furthermore advantageous if the material web impact surfaces have a grid-like structure and, for compressively receiving a material web section hurled against them, are constructed to be outwardly and downwardly curved.

In order to produce material which has as small as possible a residual shrinkage potential at the output side of the apparatus, it is advantageous if at least one shrink-drier is arranged upstream of the first material web store and/or at least one shrink-drier is arranged downstream of the second material web store. Here, especially in treating plush and towelling material, it is advantageous if the at least one shrink-drier is provided, for receiving and transporting the material to be treated through the shrink-drier and for depositing the material emerging therefrom into the first material web store or for receiving the material deposited from the second or last material web store, with a continuously drivable air-permeable endlessly circulating conveyor belt on which there is arranged, for forming a transport channel which is upwardly and downwardly delimited in the vertical direction and serves to receive and vertically support the material to be treated, an upper stationary and air-permeable delimitation wall through which downwardly directed blower nozzles running transversely with respect to the direction of conveying of the material web pass, and in that, preferably as seen in the direction B in which the material runs through, upwardly directed blower nozzles which are arranged offset with respect to the latter blower nozzles below the upper side of the lower conveyor belt and preferably supporting the upper side thereof are provided. Advantageous further developments of the shrink-drier are the subject of claims 18 to 22.

The invention will be explained below by way of example with reference to the drawing, in which.

Figure 1:
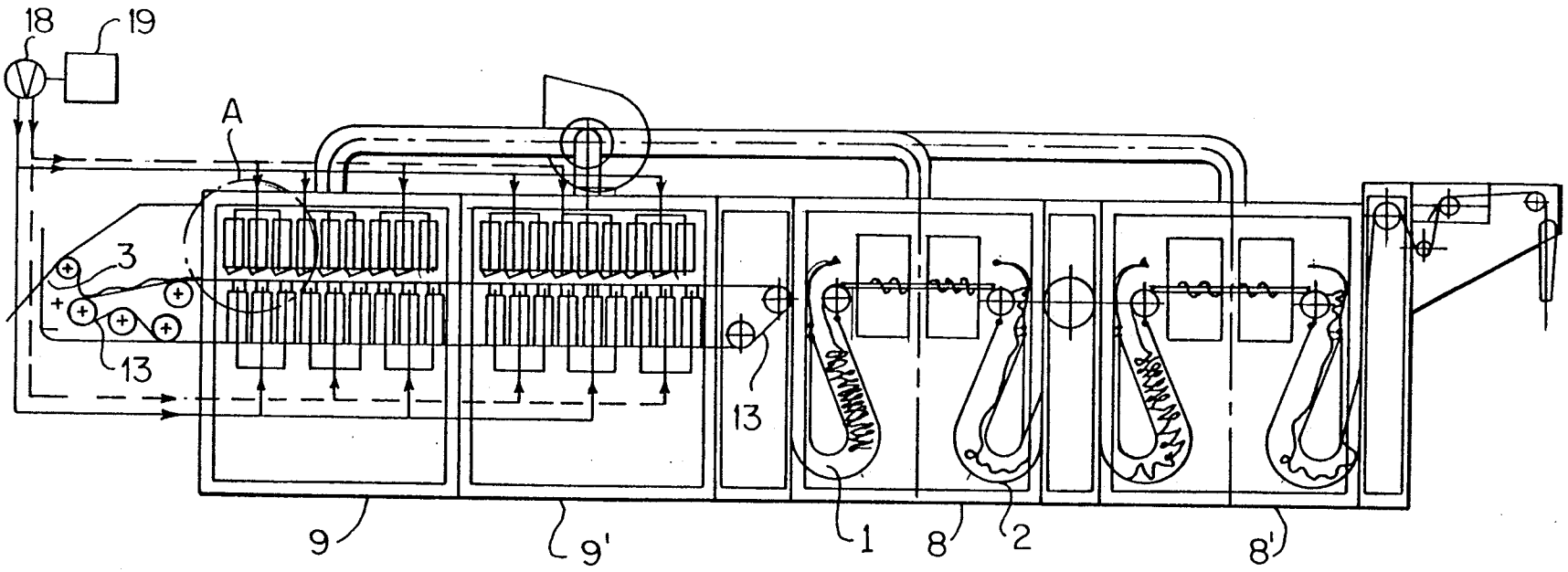
FIG. 1 shows a longitudinal section through an example embodiment of an apparatus according to the invention.
Figure 2:
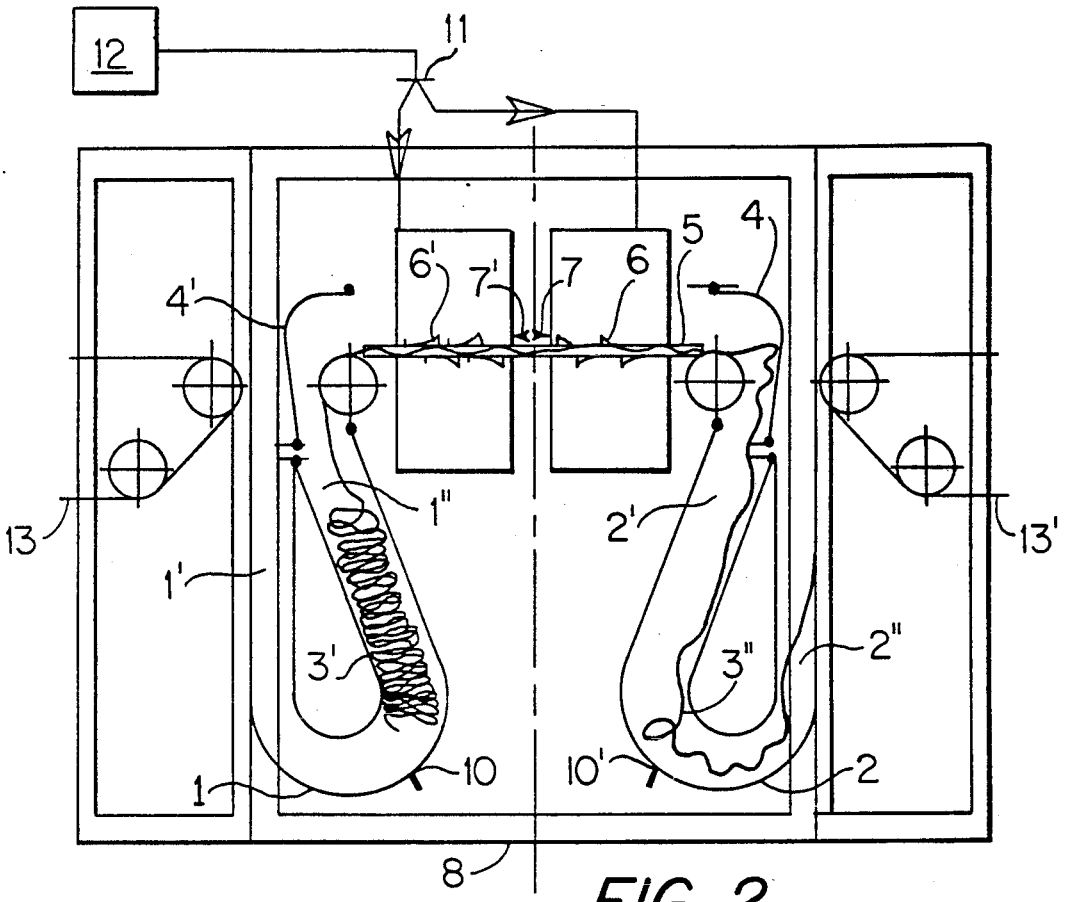
FIG. 2 shows a component of the apparatus illustrated in FIG. 1, on an enlarged scale.

As is clear in particular from FIGS. 1 and 2, the apparatus illustrated has two approximately U-shaped material web stores 1 and 2 for loosely receiving a respective material web section 3' and 3'', and arranged between these two material web stores 1, 2 a material web guidance and acceleration channel 5 which connects them to one another and is delimited in its longitudinal direction at its two end sides by a respective material web impact surface 4 and 4'.

Pneumatic conveying means 6 and 6' which are connected to the material web guidance and acceleration channel 5 and can be brought into effect in a manner such that they can be changed over in the two mutually opposed longitudinal directions of the material web guidance and acceleration channel 5 serve to alternately convey a material web section of the material web 3 to be treated in the mutually opposed longitudinal directions 7, 7' (FIG. 3) of the guidance and acceleration channel 5 towards the respective end-side material web impact surface 4 and 4' and from there into the respectively associated material web store 2 or 1 arranged below the latter.

This component 8 can be used alone or, as in the embodiment illustrated, for example with two entry-side shrink-driers 9 and 9', the latter at the same time serving as a supply arrangement 9 for continuously supplying the material web 3 to be treated to the first material web store 1.

For controlling the direction of conveying of the pneumatic conveying means 6, 6', there are provided in the lower bent regions of the two material web stores 1 and 2 optical sensor means 10 and 10' in order to sense the level of filling of the two material web stores 1 and 2 with part sections 3' and 3'' respectively of the material web 3 to be treated.

Figure 3:
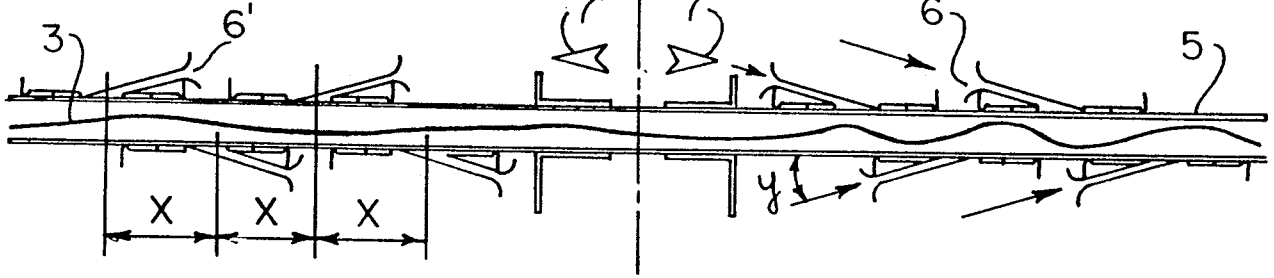
FIG. 3 shows a longitudinal section through the guidance and acceleration channel of the component illustrated in FIG. 2, on an enlarged scale.

To bring about the mutually opposed directions of conveying of the material 3 to be treated, the pneumatic conveying means associated with the acceleration channel 5, as can be seen in particular from FIG. 3, are divided into two pneumatic conveying means groups (blower nozzles) 6 and 6' acting in mutually opposed directions of the acceleration channel 5. These two blower nozzle groups 6 and 6' are connected to a compressed-air source 12, alternating separately from one another, for example by way of a flip-flop changeover element 11 (see FIG. 2) which operates in accordance with the Coanda effect principle. The air used for this purpose can be at a temperature in the range of for example approximately 80° to 200° C., depending on the material.

Figure 4:
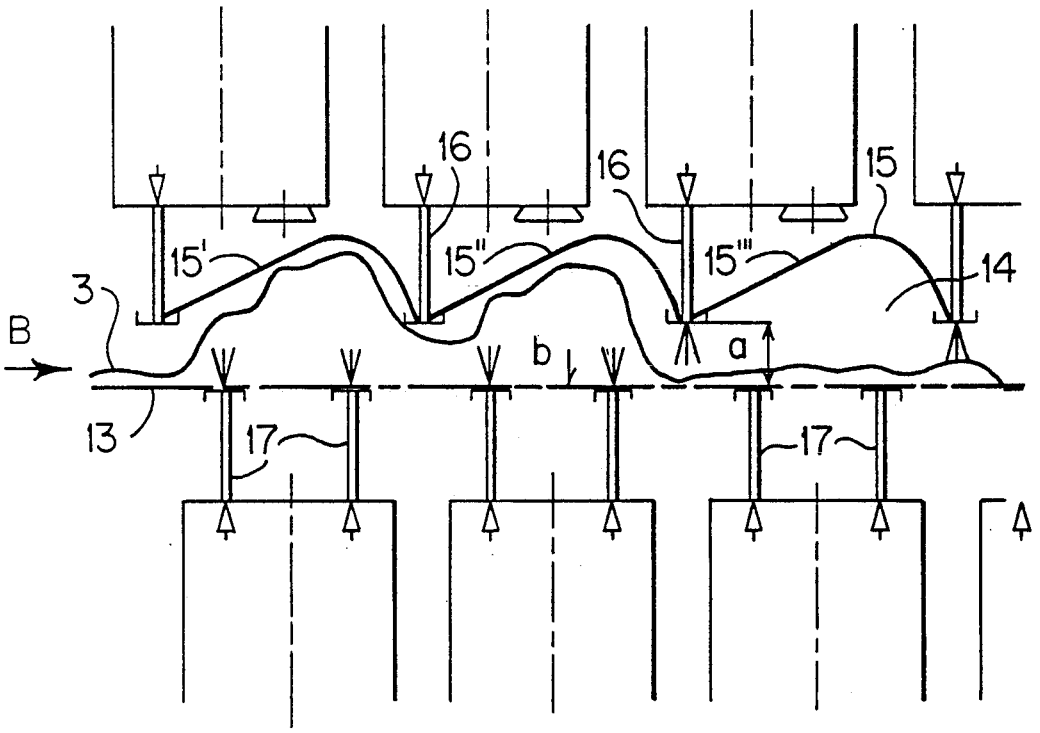
FIG. 4 shows the section A from FIG. 1 on an enlarged scale.

As is particularly clear from FIGS. 1 and 4, the two shrink-driers 9 and 9' are provided, for receiving and transporting the material 3 to be treated through the shrink-driers and for depositing the material 3 emerging from the shrink-drier 9' into the first material web store 1, with a common continuously drivable air-permeable endlessly circulating conveyor belt 13 which is driven at a conveying speed of approximately 40 to 50 meters per minute. Arranged on the latter, for forming a transport channel 14 which is delimited upwardly and downwardly in the vertical direction and serves to receive and vertically support the material 3 to be treated is an upper stationary and air-permeable delimitation wall 15 through which downwardly directed blower nozzles 16 running transversely with respect to the direction of conveying of the material web pass.

To produce as small as possible a residual shrinkage potential, the upper delimitation wall 15, which is perforated to be air-permeable, has at least approximately the shape of a shed roof, as seen in a vertical section running longitudinally with respect to the direction of transport of the material web (see in particular FIG. 4), there being arranged between each two mutually adjacent angular sections 15', 15'', 15''' , etc. a respective downwardly directed blower nozzle 16 which at the same time is constructed to support the associated sections 15', 15'', 15''' etc.

For optimum individual adaptation of the flow conditions to the fabric to be dried, the spacing a of the upper blower nozzles 16 and thus of the upper delimitation wall 15 supported thereon is adjustable with respect to the bearing surface b of the conveyor belt 13, for example in a range from approximately 10 to 80 mm.

As seen in a horizontal plane, there are provided between each two upper blower nozzles 16 two lower blower nozzles 17 which support the upper side of the conveyor belt 13 and are directed upwardly into the associated angular sections 15', 15'', 15''' etc. of the upper delimitation wall 15.

The lateral horizontal spacing of the upper blower nozzles 16 from one another is approximately 190 mm, and that of the lower blower nozzle 17 from one another is approximately 95 mm.

The upper and the lower blower nozzles 16 and 17 supplying drying air are each divided into groups and can be connected to act alternately and in the manner of a pulse approximately twice per second to a hot air source 19 by way of the changeover means 18. The division and changeover is in this case such that there is opposite each active blower nozzle group an inactive blower nozzle group, and the blower nozzle groups which are laterally directly adjacent to an active blower nozzle group are inactive. In this way, it is ensured that alternately one section of the material 3 passing through a shrink-drier 9 or 9' is pressed down by upper blower nozzles 16 onto the bearing surface b of the endlessly circulating conveyor belt 13 and is thus necessarily conveyed through the corresponding shrink-drier 9 or 9' together with this conveyor belt 13.

The alternating action in the manner of a pulse on the material moved through the shrink-drier from below and from above by hot air pulses, the fluttering movement of the material 3 effected thereby in the vertical direction of the transport channel 14, and the simultaneous compression of the material 3 passing through in the approximately angular air-permeable sections 15', 15'', 15''' etc. of the upper delimitation wall 15 have the effect of an extremely effective drying, shrinking and relaxing of the material 3 passing through.

The previously treated material 3 emerging continuously from the second shrink-drier 9' reaches the first material web store 1 with a residual moisture of preferably less than 20%, but at least 6%, and is stored there in a loose state in sections. From this, the material web 3 is removed, as already mentioned, pneumatically in sections with the aid of the nozzle arrangement 6, is accelerated in the acceleration channel 5 to a speed of approximately 600 to 800 m/min, depending on the type of material, and at the end of this acceleration path 5 is hurled against the impact surface 4, which is constructed in the manner of a grid and is curved, and compressed there. As a result of the grid-type and thus air-permeable construction of the impact surface 4, the possibility of an air cushion damping the impact being formed between the impacting material web section and the impact surface 4 is eliminated.

Then, the same procedure is repeated with the aid of the nozzle arrangement 6' acting with the opposite conveying action from the second material web store 2 by way of the impact surface 4' to the second material web store 1, but with a smaller length advance of the material web, these to-and-fro movements are repeated alternately, and the difference in advance occurring during this between these length sections of material web moved to and fro in this manner is guided away continuously from the second material web store 2 to the adjacent second shrink-drier 10 for final treatment. Thereafter, the same treatment steps are repeated in a subsequent analogous component 8'.

In order that both light and heavy material can be accelerated through the acceleration channel 5 without problems, the two pneumatic conveying means groups 6, 6' have on either side of the acceleration channel 5 blower nozzles which are arranged offset with respect to one another alternately by the spacing[1], and are directed obliquely with respect to the plane of transport of the material web by the angle y, as a result of which the material 3 to be transported through the acceleration channel 5 towards the impact surface 4 is given the shape of a wave in the region of the active blower nozzle group 6 (right-hand side of FIG. 3), as a result of which the transporting air acts extremely efficiently on the material 3 to be transported in this region and brings about a very good transporting effect thereon.

[1] Translator's Note: A reference numeral may have been omitted here.

Since the two blower nozzle groups 6, 6' are arranged in the respective end region of the acceleration channel 5, as seen in the direction of transport, any compression and clogging of the material 3 during its transport through the acceleration channel 5 as a result of the tensile force acting in this manner on the material 3 to be transported is properly eliminated.

Depending on the type of material 3, it can also be advantageous to supply saturated steam to the nozzle arrangement 6 and/or 6' during its use in order to subject the material 3 running through additionally to a saturated steam treatment before it enters the second shrink-drier 10, to produce an even greater and more even shrinkage.

Depending on the type of material 3 and the degree of treatment desired, it can in some circumstances be advantageous to arrange one or more shrink-driers similar to the shrink-driers 9 and 9' downstream of the last component 8'.

I claim:

1. A process for continuously improving the handle and surface of textile fabrics and knitted materials, said process comprising the steps of:

continuously supplying a material web to a first material web store;

storing said material web in said first material web store in sections;

removing said material web from said first material web store by pneumatic conveying means;

hurling said material web compressively against a first impact surface so as to compress said material web;

supplying said compressed material web to a second material web store and storing said compressed material web in sections therein, reversing the direction of material web movement so said material web advances from said second material web store against a second impact surface, and thereafter to said first material web store, but with a smaller length of said material web, said material web being hurled at a speed between 400 and 1000 m/min against said first and second impact surfaces; and alternating said material web movement between said first and second material web store while continuously guiding away said material web from said second material web store.

2. The process according to claim 1, characterized in that said material web guided away from said second material web store is then subjected at least one more time to a similar treatment process.

3. The process according to claim 1, characterized in that said material web stores are U-shaped material web stores, said material web being introduced continuously into one leg of said first U-shaped material web store being removed continuously alternately and in sections from a second leg of said first U-Shaped material web store, being returned again thereto in the opposite direction of transport, being removed therefrom again, said material being introduced continuously alternately and in sections into one leg of said second U-shaped material web store.

4. The process according to claim 1 characterized in that the to-and-fro movement of said material web sections between said impact surfaces is controlled by means of monitoring means which senses the level of filling of said material web stores.

5. The process according to claim 1, characterized in that said conveying of said material web is carried out with the aid of blower nozzles which are arranged laterally offset from one another on either side of said material web, are directed obliquely with respect to the plane of transport of said material web, and are arranged directly in front of said impact surfaces.

6. The process according to claim 1, characterized in that said material web which enters said first material web store for the first time has a residual moisture of less than 20%, but at least 6%.

7. The process according to claim 1, characterized in that said material web is pre-treated in at least one shrink-drier before said material web enters said first material web store for the first time.

8. The process according to claim 1, characterized in that said material web is subjected to a saturated steam treatment while said material web is conveyed from one material web store to said respective impact surface which is disposed downstream.

9. The process according to claim 1, wherein the said material web is hurled at a speed between 600 to 800 m/min against said first and second impact surfaces.

10. An apparatus for continuously improving the handle and surface of textile fabrics and knitted material webs, said apparatus comprising:

two material web stores, each for loosely receiving one section of said material web;

a material web guidance and acceleration channel, said channel being arranged between said material web stores, said channel connecting said material web stores to one another;

two material web impact surfaces, each associated with a respective material web store;

a pneumatic conveying means which is connected to said material web guidance and acceleration channel, for alternately conveying a material web section in mutually opposed longitudinal directions of said guidance and acceleration channel against said respective material web impact surface and from said impact surface into said respectively associated material web store, said pneumatic conveying means associated with said acceleration channel being divided into two pneumatic conveying means groups acting in mutually opposed directions of said acceleration channel, and said two groups being connected to a compressed-air source, alternating separately from one another, by way of a changeover element, said two groups having on either side of said acceleration channel blower nozzles which are arranged alternately laterally offset with respect to one another and directed obliquely with respect to a plane of transport of said material web, and said two groups being arranged in an end region of said acceleration channel, as seen in their respective direction of conveying;

a supply arrangement for continuously supplying said material web to said first material web store; and a removal arrangement for continuously guiding away said material web from said second web store.

11. The apparatus recited in claim 10, wherein said two material web stores are U-shaped, one leg of said U-shaped first material web store being constructed for the continuous temporary receiving of said material web and the other leg being constructed for the continuously alternating removal, receiving, and renewed removal, and one leg of said second U-shaped material web store being constructed for the continuously alternating receiving, removal, and renewed receiving, and the other leg of said second material web store for the continuous removal of said material web; and an optical sensor means provided in each of said U-shaped material web stores for sensing the level of filling of said U-shaped material web stores.

12. The apparatus recited in claim 10, wherein said supply and removal arrangements are constructed to be regulable independently of one another with respect to respect transporting speeds.

13. The apparatus recited in claim 10, wherein said material web impact surfaces have a grid-like structure, said material web impact surfaces are for compressively receiving a section of said material web hurled thereagainst, and said impact surfaces being constructed to be outwardly and downwardly curved.

14. The apparatus recited in claim 10, further comprising a plurality of apparatus for continuously improving the handle and surface of textile fabrics and knitted material webs which are connected in series.

15. The apparatus recited in claim 10, further comprising at least one-shrink-drier which is arranged upstream of said first material web store or at least one shrink-drier arranged downstream of said last material web store.

16. The apparatus recited in claim 15, wherein at least one shrink-drier is provided, for receiving and transporting said material web and for forming a transport channel, said transport channel is upwardly and downwardly delimited in a vertical direction and serves to receive and vertically support said material web, an upper stationary and air-permeable delimitation wall is provided, downwardly directed blower nozzles running transversely with respect to the direction of conveying of said material web and blowing downwardly through said air-permeable delimitation wall and upwardly directed blower nozzles are arranged offset with respect to said downwardly directed blower nozzles and below an upper side of a lower conveyor belt and supporting said upper side thereof.

17. The apparatus recited in claim 16, wherein said upper air-permeable delimitation wall has the shape of a wave, as seen in a vertical section running longitudinally with respect to the direction of transport of said material web.

18. The apparatus recited in claim 16, wherein said upper and lower blower nozzles are each divided into groups and are connected to a fan by way of changeover means, said division and changeover being such that an inactive blower nozzle group is opposite each active blower nozzle group and blower nozzle groups which are laterally directly adjacent to said active blower nozzle groups, and said changeover of said respective blower nozzle groups between said active and inactive state acts as a pulse.

19. The apparatus recited in claim 16, wherein a vertical spacing between emergence openings of said upper and lower blower nozzles is adjustable in a range of approximately 10 to 80 mm, and said conveyor belt having a transport speed in the range of 40 to 50 m/sec.

20. The apparatus recited in claim 16, wherein a lateral spacing between said upper blower nozzles is approximately 190 mm, and a lateral spacing between said lower blower nozzles is approximately 95 mm.

21. The apparatus recited in claim 10, wherein said guidance and acceleration channel runs in the shape of a wave, as seen in a vertical plane in a longitudinal direction.

* * * * *